US010085569B2

(12) United States Patent
Liu et al.

(10) Patent No.: US 10,085,569 B2
(45) Date of Patent: Oct. 2, 2018

(54) INFLATION AND DEFLATION PRESSURE REGULATION SYSTEM

(71) Applicant: APEX MEDICAL CORP., New Taipei (TW)

(72) Inventors: Shih-Chung Liu, New Taipei (TW); Ming-Heng Hsieh, New Taipei (TW)

(73) Assignee: APEX MEDICAL CORP., New Taipei (TW)

( * ) Notice: Subject to any disclaimer, the term of this patent is extended or adjusted under 35 U.S.C. 154(b) by 263 days.

(21) Appl. No.: 14/664,112

(22) Filed: Mar. 20, 2015

(65) Prior Publication Data

US 2016/0270547 A1 Sep. 22, 2016

(51) Int. Cl.

| | |
|---|---|
| ***A47C 27/08*** | (2006.01) |
| ***A47C 27/10*** | (2006.01) |
| ***A47C 21/08*** | (2006.01) |

(52) U.S. Cl.

CPC ..... *A47C 27/10* (2013.01); *A47C 27/08* (2013.01); *A47C 27/082* (2013.01); *A47C 27/083* (2013.01)

(58) Field of Classification Search

CPC ..... A47C 27/10; A47C 27/081; A47C 27/082; A47C 27/083; A47C 27/128; A47C 27/08; A47C 21/08

See application file for complete search history.

(56) References Cited

U.S. PATENT DOCUMENTS

| | | | | |
|---|---|---|---|---|
| 4,995,124 | A * | 2/1991 | Wridge, Jr. | A47C 27/083 5/709 |
| 5,020,176 | A * | 6/1991 | Dotson | A47C 27/082 137/487.5 |
| 6,483,264 | B1 * | 11/2002 | Shafer | A47C 27/082 318/16 |
| 6,698,046 | B1 * | 3/2004 | Wu | A47C 27/082 137/625.15 |
| 6,721,980 | B1 * | 4/2004 | Price | A61B 5/0205 5/710 |
| 8,745,788 | B2 * | 6/2014 | Bhai | A61G 7/05769 5/600 |
| 8,973,186 | B2 * | 3/2015 | Bhai | A61G 7/015 5/600 |
| 9,370,457 | B2 * | 6/2016 | Nunn | A61G 7/015 |
| 9,597,244 | B2 * | 3/2017 | Ishibashi | A47C 27/083 |

(Continued)

*Primary Examiner* — Nicholas F Polito
*Assistant Examiner* — Rahib T Zaman
(74) *Attorney, Agent, or Firm* — Muncy, Geissler, Olds & Lowe, P.C.

(57) ABSTRACT

An inflation and deflation pressure regulation system is applicable to an air mattress with at least two air arrays, the inflation and deflation pressure regulation system comprising an inflation and deflation device, a pressure detection unit and a control unit. The inflation and deflation device inflates or deflates the air mattress; the pressure detection unit continuously detects an instantaneous pressure value of the air mattress; the control unit determines whether the instantaneous pressure value detected by the pressure detection unit when the air mattress is in a weight-bearing state has reached a preset pressure value before a preset time has elapsed, and accordingly uses a first inflation and deflation strategy or a second inflation and deflation strategy to control the inflation and deflation device to inflate or deflate the air mattress.

19 Claims, 6 Drawing Sheets

(56) References Cited

U.S. PATENT DOCUMENTS

| | | | | |
|---|---|---|---|---|
| 2010/0170044 | A1* | 7/2010 | Kao | A47C 27/082 5/710 |
| 2012/0047647 | A1* | 3/2012 | Steers | A47C 27/082 5/13 |
| 2013/0031725 | A1* | 2/2013 | Riley | A47C 27/083 5/713 |
| 2014/0298589 | A1* | 10/2014 | Bailey | A47C 27/10 5/710 |
| 2015/0164236 | A1* | 6/2015 | Driscoll, Jr. | A47C 27/083 5/713 |

* cited by examiner

INFLATION AND DEFLATION PRESSURE REGULATION SYSTEM

FIELD OF THE INVENTION

This invention relates to an inflation and deflation pressure regulation system and method and more particularly to an inflation and deflation pressure regulation system and method capable of performing inflation and deflation operations according to the variation of weight pressure detected. This invention also provides an air mattress system using the inflation and deflation pressure regulation system.

BACKGROUND OF THE INVENTION

Medical grade air mattresses are useful for bedridden patients to relieve local stress concentration caused by lying and prevent bedsores. When in use, an inflation and deflation device is connected to an air mattress via an air delivery conduit to establish air communication between the inflation and deflation device and the air mattress so as to inflate or deflate the air mattress.

Due to the difference in body weight of individual patients, the pressure borne by the air mattress may be changed. Therefore, the air mattress needs adjustment of internal air pressure according to the physical condition of different patients so as to provide sufficient support to bear patients and provide them with lying comfort.

Most conventional air mattresses are formed by multiple air cells. By using two independent air arrays that are respectively communicated with a part of the air cells, the inflation and deflation rate can be increased and controlled easily. Conventionally, the two independent air arrays of the air mattress are inflated at the same time to a preset pressure value; after that, a patient lies on the air mattress, and the pressure change of the air mattress is detected. Only after the pressure has reached a steady state for a period of time (e.g. 40 seconds), will the pressure value be used to determine the body weight section or interval corresponding to the patient, followed by the adjustment of the air mattress to a proper pressure value corresponding to the body weight section or interval.

However, it takes quite a long time for the air mattress to reach the steady state after the patient lies thereon, and still another long period of time is necessary after the pressure has become steady, so a long waiting time will be needed for the pressure regulation of the air mattress, which is time-consuming and results in bad user experience. Accordingly, improvements are needed for the conventional inflation and deflation pressure regulation system of the air mattress.

SUMMARY OF THE INVENTION

An objective of this invention is to provide an inflation and deflation pressure regulation system which is capable of detecting weight pressure variation to perform corresponding inflation and deflation operations, such that the air mattress may regulate the supporting pressure in a more stable and faster way to meet the demands of patients.

To achieve the aforesaid objective, provided is an inflation and deflation pressure regulation system applicable to an air mattress with at least two air arrays, the inflation and deflation pressure regulation system comprising an inflation and deflation device, a pressure detection unit and a control unit. The inflation and deflation device inflates or deflates the air mattress; the pressure detection unit continuously detects an instantaneous pressure value of the air mattress; the control unit determines whether the instantaneous pressure value detected by the pressure detection unit when the air mattress is in a weight-bearing state has reached a preset pressure value before a preset time has elapsed; if so, the control unit using a first inflation and deflation strategy to control the inflation and deflation device to inflate or deflate the air mattress; if not, the control unit using a second inflation and deflation strategy to control the inflation and deflation device to inflate or deflate the air mattress.

An inflation and deflation pressure regulation method of this invention is applicable to the above-recited inflation and deflation pressure regulation system, the method comprising the following steps: performing an automated detection for inflation and deflation process, during which the control unit continuously obtains the instantaneous pressure value of the air mattress detected by the pressure detection unit and enables the inflation and deflation device to discharge air in any one of the air arrays of the air mattress; using the control unit to determine whether the instantaneous pressure value of the air mattress in a weight-bearing state has reached a preset pressure value before a preset time has elapsed; if so, the control unit employing a first inflation and deflation strategy for the air mattress; and if not, the control unit employing a second inflation and deflation strategy for the air mattress.

An air mattress system of this invention comprises an air mattress and the above-recited inflation and deflation pressure regulation system. The air mattress comprises a first air array and a second air array, the first air array comprising a first inner cell and a first outer cell, the second air array comprising a second inner cell and a second outer cell, the first outer cell being communicated with the second inner cell via a first check valve, the second outer cell being communicated with the first inner cell via a second check valve; the inflation and deflation pressure regulation system is in air communication with the air mattress, wherein the inflation and deflation pressure regulation system inflates each of the first air array and the second air array to a reference pressure value.

BRIEF DESCRIPTION OF THE DRAWINGS

A more complete understanding of the subject matter can be derived by referring to the detailed description and claims when considered in conjunction with the following figures, wherein like reference numbers refer to similar elements throughout the figures.

DETAILED DESCRIPTION OF THE INVENTION

Since various aspects and embodiments are merely exemplary and not limiting, after reading this specification, skilled artisans appreciate that other aspects and embodiments are possible without departing from the scope of the invention. Other features and benefits of any one or more of the embodiments will be apparent from the following detailed description and the claims.

The use of "a" or "an" is employed to describe elements and components described herein. This is done merely for convenience and to give a general sense of the scope of the invention. Accordingly, this description should be read to include one or at least one and the singular also includes the plural unless it is obvious that it is meant otherwise.

As used herein, the terms "first," "second," "third" and the like are used for distinguishing between or referring identical or similar elements or structures and not necessarily for describing a sequential or chronological order thereof. It should be understood that the terms so used are interchangeable under appropriate circumstances or configurations.

Furthermore, as used herein, the terms "comprises," "comprising," "includes," "including," "has," "having" or any other variation thereof are intended to cover a non-exclusive inclusion. For example, a component, structure, article, or apparatus that comprises a list of elements is not necessarily limited to only those elements but may include other elements not expressly listed or inherent to such component, structure, article, or apparatus.

Figure 1:
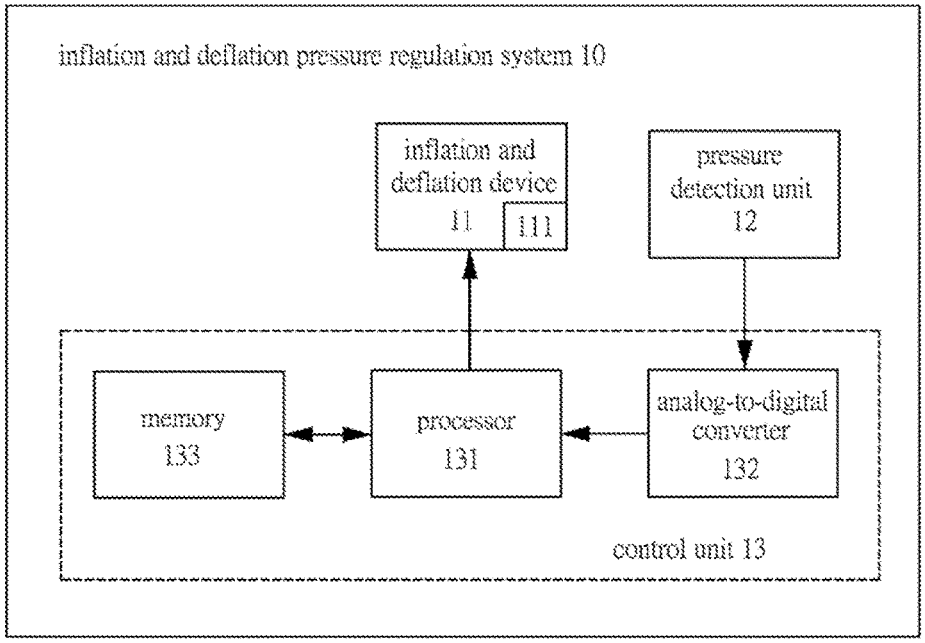
FIG. 1 illustrates a systematic block diagram of an inflation and deflation pressure regulation system.

FIG. 1 illustrates a systematic block diagram of the inflation and deflation pressure regulation system 10 according to the present invention. As shown by FIG. 1, the inflation and deflation pressure regulation system 10 is applicable to an air mattress, particularly the one with at least two air arrays. The air mattress consists of a plurality of air cells arranged in order, each air array comprising a part of air cells communicated with each other. In one embodiment, the air mattress has two independent air arrays, one of which is communicated with all odd-numbered air cells, and the other of which is communicated with all even-numbered air cells, but this invention is not limited thereto. Since the air array and air cell structures of an air mattress are already known to skilled artisans, detailed elaboration is omitted herein for brevity.

The inflation and deflation pressure regulation system 10 may detect the pressure variation of the air mattress in a weight-bearing state to determine whether to perform inflation or deflation on the air mattress to adjust the pressure of the air mattress. In one embodiment, the inflation and deflation pressure regulation system 10 comprises an inflation and deflation device 11, a pressure detection unit 12 and a control unit 13; the control unit 13 is electrically connected with the inflation and deflation device 11 and the pressure detection unit 12. The inflation and deflation device 11 may be communicated with the air mattress via an air delivery conduit to form a closed air circuit. After the inflation and deflation device 11 has received an instruction and begun operating, the air mattress may be inflated or deflated. In one embodiment, the inflation and deflation device 11 may be an air pump or other component capable of performing inflation and deflation.

The inflation and deflation device 11 may further comprise a deflation unit 111. The deflation unit 111 may be communicated with the air delivery conduit, and the deflation unit 111 may be switched on during the operation of the inflation and deflation device 11 to allow heat dissipation. In one embodiment, the deflation unit 111 is a deflation valve or other component capable of performing similar functions.

The pressure detection unit 12 is arranged in the closed air circuit for continuously detecting the pressure in the air mattress so as to obtain instantaneous pressure values and transmit the instantaneous pressure values thus obtained to the control unit 13 for subsequent processing and determination. In this embodiment, the pressure detection unit 12 is a pressure sensor.

The control unit 13 continuously receives the instantaneous pressure values from the pressure detection unit 12 and performs processing, comparison and/or determination thereof, so as to control the inflation or deflation operation of the inflation and deflation device 11 according to the comparison and/or determination results. In one embodiment, the control unit 13 determines whether an instantaneous pressure value detected by the pressure detection unit 12 when the air mattress is in a weight-bearing state (i.e. the state of the air mattress bearing thereon a patient) has reached a preset pressure value before a preset time has elapsed. In addition, the aforesaid preset time and preset pressure value as the bases for the determination by the control unit 13 may be set or stored in advance or set or adjusted by users.

In one embodiment, the control unit 13 defines a first inflation and deflation strategy and a second inflation and deflation strategy for controlling the inflation and deflation device 11, such that the inflation and deflation device 11 may be controlled differently under different conditions; in other words, the control unit 13 decides whether to use the first inflation and deflation strategy or the second inflation and deflation strategy according to the comparison and/or determination results of the instantaneous pressure value to control the inflation and deflation device 11, wherein the first inflation and deflation strategy and the second inflation and deflation strategy are described in detail below.

In one embodiment, the control unit 13 comprises a processor 131 and an analog-to-digital converter 132. The processor 131 determines whether the instantaneous pressure value has reached the preset pressure value before the preset time has elapsed and generates an instruction corresponding to the comparison and/or determination results to control the inflation and deflation device 11. In this embodiment, the processor 131 may be a central processing unit or a microcontroller.

The analog-to-digital converter 132 is electrically connected with the processor 131 and the pressure detection unit 12. The analog-to-digital converter 132 performs analog-to-digital signal conversion on the instantaneous pressure values continuously obtained by the pressure detection unit 12, and the processed signals are transmitted to the processor 131 for comparison and/or determination.

The control unit 13 further comprises a memory 133 electrically connected with the processor 131. The memory 133 may save the instantaneous pressure values obtained, the preset pressure value and the preset time, which may be read and compared by the processor 131 if necessary. In one embodiment, the memory 133 may be a memory (e.g. RAM) in the processor 131, an independent and standalone memory unit, a hard disk drive or other component with data storage capability. The memory can be configured as other forms according to the need and is not limited to those exemplified above.

Figure 2:
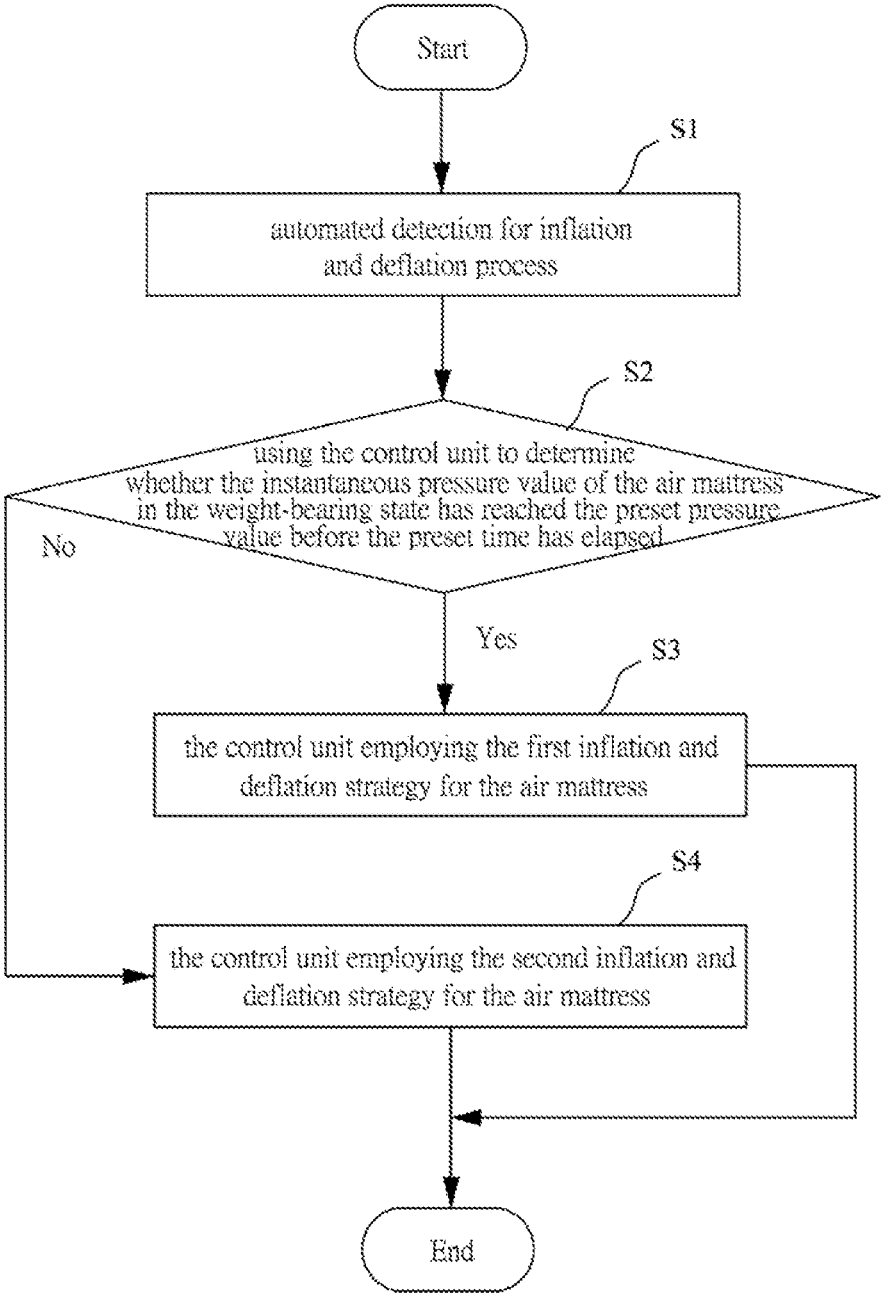
FIG. 2 illustrates a flowchart of the first embodiment of an inflation and deflation pressure regulation method.

FIG. 2 illustrates a flowchart of the first embodiment of the inflation and deflation pressure regulation method according to the present invention. The inflation and deflation pressure regulation method will be now described in detail in conjunction with and with reference to the inflation and deflation pressure regulation system 10 illustrated in FIG. 1, but it should be noted that the method may also be implemented with other configurations. As shown in FIG. 2, the inflation and deflation pressure regulation method comprises Steps S1 to S4, which are exemplified in detail below.

Step S1: performing an automated detection for inflation and deflation process, during which the control unit 13 continuously obtains an instantaneous pressure value of the air mattress detected by the pressure detection unit 12 and enables the inflation and deflation device 10 to discharge air in any one of the air arrays of the air mattress.

First, the inflation and deflation pressure regulation system performs an automated detection for inflation and deflation process on the air mattress. In the first embodiment of the inflation and deflation pressure regulation method, the air mattress is communicated with the inflation and deflation device 11 to form a closed air circuit. The pressure detection unit 12 arranged in the closed air circuit may incessantly detect the current pressure of the air mattress so as to continuously obtain the instantaneous pressure value of the air mattress and transmit the same to the control unit 13. The control unit 13 continuously receives the instantaneous pressure value of the air mattress and enables the inflation and deflation device 11 to discharge air in any one of the air arrays of the air mattress; in other words, given that the air mattress contains two air arrays, the control unit 13 may be programmed to instruct the inflation and deflation device 11 to discharge air in one of the two air arrays and retain the inflation status of a single air array; for example, air in odd-numbered air cells is discharged, and air in even-numbered air cells are held, vice versa.

Figure 3:
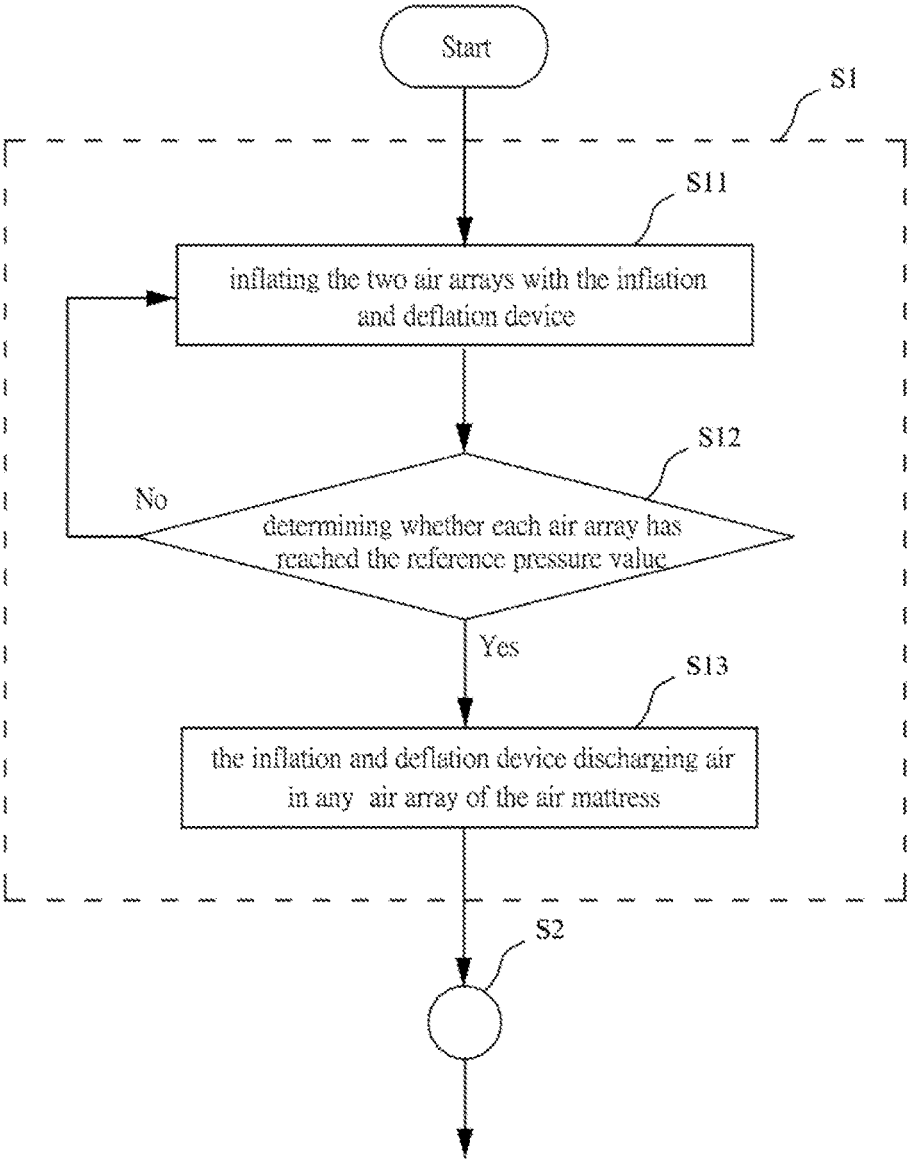
FIG. 3 illustrates a detailed flowchart for the automatic pressure detection process of the first embodiment of the inflation and deflation pressure regulation method.

Reference is now made to FIG. 3, which illustrates a detailed flowchart for the automatic pressure detection process of the first embodiment of the inflation and deflation pressure regulation method. As shown in FIG. 3, the automatic pressure detection process of the inflation and deflation pressure regulation method further comprises Steps S11 to S13, which are described in detail below.

Step S11: inflating the two air arrays with the inflation and deflation device 11.

After the air mattress and the inflation and deflation device 11 are mutually communicated, the inflation and deflation device 11 is used to inflate both air arrays of the air mattress.

Step S12: determining whether each air array has reached the reference pressure value.

During the inflation by the inflation and deflation device 11, the control unit 13 continuously obtains the instantaneous pressure value of the air mattress from the pressure detection unit 12, so as to determine whether each air array of the air mattress has reached the reference pressure value. The reference pressure value serves as a standard for pressure comparison by the control unit 13 and similarly may be preset for the control unit 13 or set or adjusted by users according to the need and stored in the memory 133. If the control unit 13 determines that each air array of the air mattress has reached the reference pressure value, proceed to Step S13; otherwise, go back to Step S11 to continue inflation by the inflation and deflation device 11 and detection of the instantaneous pressure value.

Step S13: the inflation and deflation device 11 discharging air in any air array of the air mattress.

After the control unit 13 determines that each air array of the air mattress has reached the reference pressure value, a patient may then lie on the air mattress such that the air mattress enters a weight-bearing state; after that, the control unit 13 may, as programmed in advance, instructs the inflation and deflation device 11 to discharge air in one of the two air arrays and hold air in only one single air array.

Step S2: using the control unit 13 to determine whether the instantaneous pressure value of the air mattress in the weight-bearing state has reached the preset pressure value before the preset time has elapsed.

Refer back to FIG. 2. Then the control unit 13 determines whether the instantaneous pressure value obtained when the air mattress in the weight-bearing state with only one single air array inflated has reached the preset pressure value before the preset time has elapsed. If the instantaneous pressure value has reached the preset pressure value before the preset time has elapsed, it is determined that the body weight of the patient lying on the air mattress has exceeded a threshold, and Step S3 is then proceeded with; otherwise, it is determined that the body weight of the patient lying on the air mattress is within a recognizable range, and Step S4 is then proceeded with.

Step S3: the control unit 13 deciding to employ the first inflation and deflation strategy for the air mattress.

If the control unit 13 determines that the instantaneous pressure value has reached the preset pressure value before the preset time has elapsed, the control unit 13 employs the first inflation and deflation strategy for the air mattress and instructs the inflation and deflation device 11 to perform corresponding inflation or deflation on the air mattress. In one embodiment, the memory 133 contains a pre-stored first lookup table which represents a plurality of different time intervals and the target pressure value corresponding to each time interval. These numbers and values may be acquired by the statistics of body weights of a large group of patients and the corresponding pressures. In this embodiment, for example, the reference pressure value is 30 mmHg, the preset pressure value is 40 mmHg, and the preset time is any time point within a time range, such as 45 to 120 seconds, 60 to 120 seconds or a different range. Preferably, the preset time is 90 seconds but not limited thereto. The first lookup table may be exemplified as Table 1 below.

TABLE 1

| Target pressure value (mmHg) | 33 | 37 | 41 | 43 | 45 |
|---|---|---|---|---|---|
| Time interval (sec) | 75-90 | 61-75 | 51-60 | 41-50 | 0-40 |

According to the first inflation and deflation strategy, the air mattress is inflated or deflated, as instructed by the control unit 13, according to the difference between the instantaneous pressure value and the target pressure value corresponding to one of a plurality of different time intervals related to the time required for the instantaneous pressure value to reach the preset pressure.

Refer to Table 1. For example, if the control unit 13 determines that the instantaneous pressure value reaches the preset pressure value (40 mmHg) at the $55^{th}$ second, which means that the instantaneous pressure value reaches the preset pressure value before the preset time (e.g. 90 seconds for a preferred embodiment) has elapsed, then the control unit 13 may find out the time interval corresponding to 55 seconds according to the first lookup table, which is 51-60 seconds in this case, and the target pressure value corresponding to the time interval, which is 41 mmHg. Accordingly, the control unit 13 may calculate the difference between the target pressure value and the instantaneous pressure value, which is +1 mmHg in this case, and use said pressure to pump up and inflate the air mattress.

With the design described above, if the control unit 13 determines that the instantaneous pressure value reaches the preset pressure value before the preset time has elapsed, at the moment the preset pressure value is reached, the control unit 13 may, with reference to the time sections enumerated in the first lookup table, find the target pressure value suitable for the air mattress and enable inflation or deflation of the air mattress immediately without having to wait for the preset time, thereby effectively reducing the time required for the operation of the air mattress.

Step S4: the control unit 13 deciding to employ the second inflation and deflation strategy for the air mattress.

If the control unit 13 determines that the instantaneous pressure value has not reached the preset pressure value before the preset time has elapsed, the control unit 13 employs the second inflation and deflation strategy for the air mattress and instructs the inflation and deflation device 11 to perform corresponding inflation or deflation on the air mattress. In one embodiment, the memory 133 contains a pre-stored second lookup table which represents a plurality of different compared pressure differences and the target pressure value corresponding to each compared pressure difference. These numbers and values may also be acquired by the statistics of body weights of a large group of patients. In this embodiment, similarly, the reference pressure value is 30 mmHg, the preset pressure value is 40 mmHg, and the preset time is preferably 90 seconds. The second lookup table may be exemplified as Table 2 below.

TABLE 2

| Target pressure value (mmHg) | 15 | 18 | 21 | 25 | 29 |
|---|---|---|---|---|---|
| Compared pressure difference (mmHg) | −8 | −6 | −4 | −2 | 0 |

According to the second inflation and deflation strategy, the air mattress is inflated or deflated, as instructed by the control unit 13, according to the difference between the instantaneous pressure value and the target pressure value corresponding to one of a plurality of different compared pressure differences related to the difference between the reference pressure value and the instantaneous pressure value at the preset time.

Refer to Table 2. For example, if the control unit 13 determines that the instantaneous pressure value (26 mmHg) has not reached the preset pressure value (40 mmHg) at the preset time ($90^{th}$ second), then the control unit 13 may find out from the second lookup table the compared pressure difference, which is −4 mmHg in this case, corresponding to the difference between the instantaneous pressure value and the reference pressure value (30 mmHg), and the corresponding target pressure value, which is 21 mmHg, of the compared pressure difference. Therefore, the control unit 13 may calculate the difference between the target pressure value and the instantaneous pressure value, which is 5 mmHg in this case, and use said pressure to pump down and deflate the air mattress.

With the design described above, if the control unit 13 determines that the instantaneous pressure value has not reached the preset pressure value before the preset time has elapsed, then the air mattress will be inflated or deflated according to the target pressure value suitable for the air mattress according to the pressure sections enumerated in the second lookup table based on the difference between the instantaneous pressure value at the moment and the reference pressure value.

Figure 4:
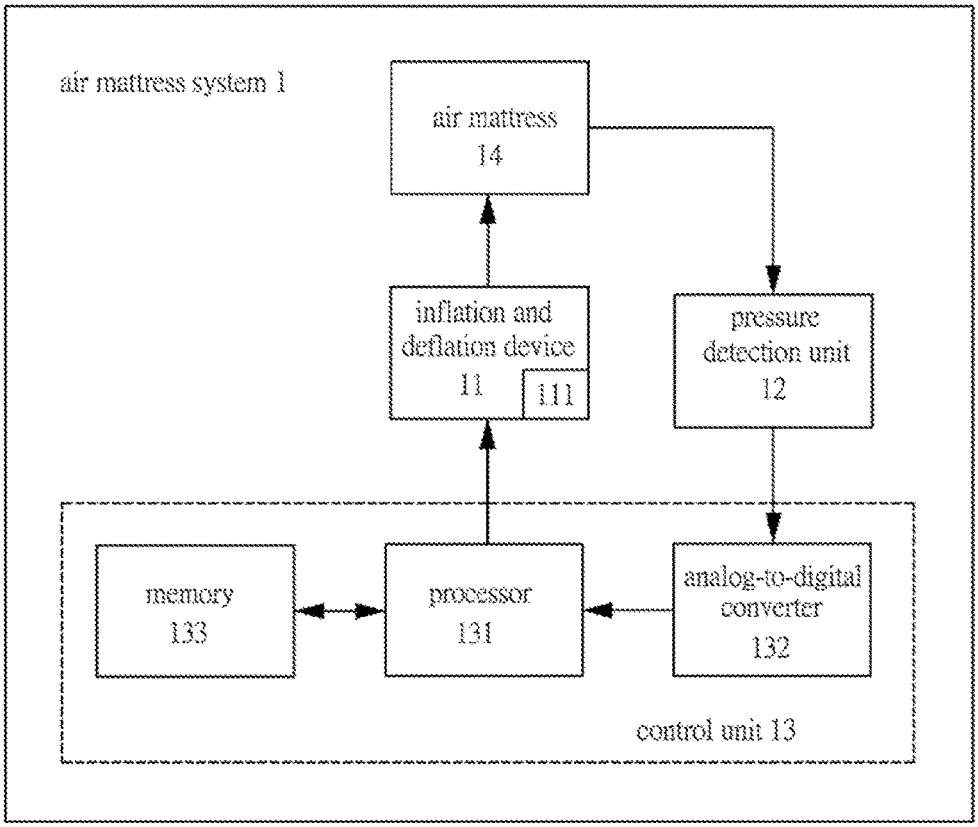
FIG. 4 illustrates a systematic block diagram of an air mattress system.
Figure 5:
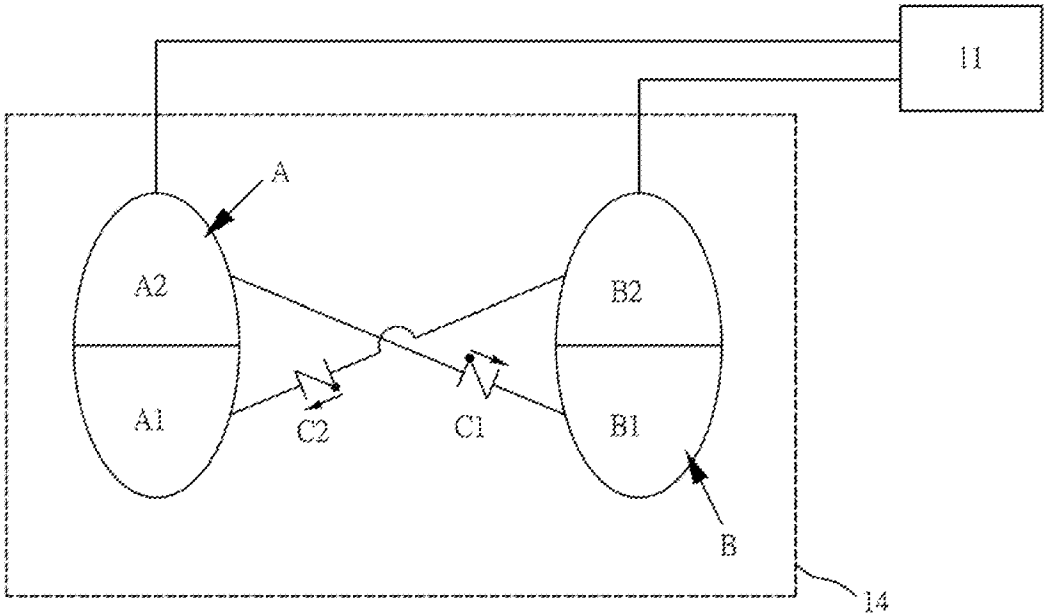
FIG. 5 illustrates the connection between cells configured in the air mattress and the inflation and deflation device of the air mattress system.

Refer now to both FIG. 4 and FIG. 5, wherein FIG. 4 illustrates a systematic block diagram of the air mattress system 1 according to the present invention, and FIG. 5 illustrates the connection between cells configured in the air mattress 14 and the inflation and deflation device 11 of the air mattress system 1. As illustrated in FIG. 4, the air mattress system 1 comprises an air mattress 14 and the aforesaid inflation and deflation pressure regulation system, wherein the air mattress 14 is in air communication with the inflation and deflation device 11, and the pressure detection unit 12 is employed for continuously detecting the pressure within the air mattress 14 to obtain the instantaneous pressure value to be transmitted to the control unit 13 for subsequent determination and comparison.

As shown in FIG. 5, in the air mattress system 1, the air mattress 14 comprises a first air array A and a second air array B, the first air array A comprising a first inner cell A1 and a first outer cell A2, the second air array B comprising a second inner cell B1 and a second outer cell B2, wherein the inflation and deflation device 11 may be communicated with the first outer cell A2 of the first air array A and the second outer cell B2 of the second air array B via two air delivery conduits. The air mattress 14 may be configured in such a way that the first outer cell A2 is communicated with the second inner cell B1 via the first check valve C1, and the second outer cell B2 is communicated with the first inner cell A1 via the second check valve C2. In should be noted that, for brevity and concise description of the connections between the first air array A and the second air array B, only one set of first inner cell A1 and first outer cell A2 is shown for the first air array A, and only one set of second inner cell B1 and second outer cell B2 is shown for the second air array B; however, the first air array A may comprise multiple sets of first inner cells A1 and first outer cells A2, and the second air array B may comprise multiple sets of second inner cells B1 and second outer cells B2.

Figure 6:
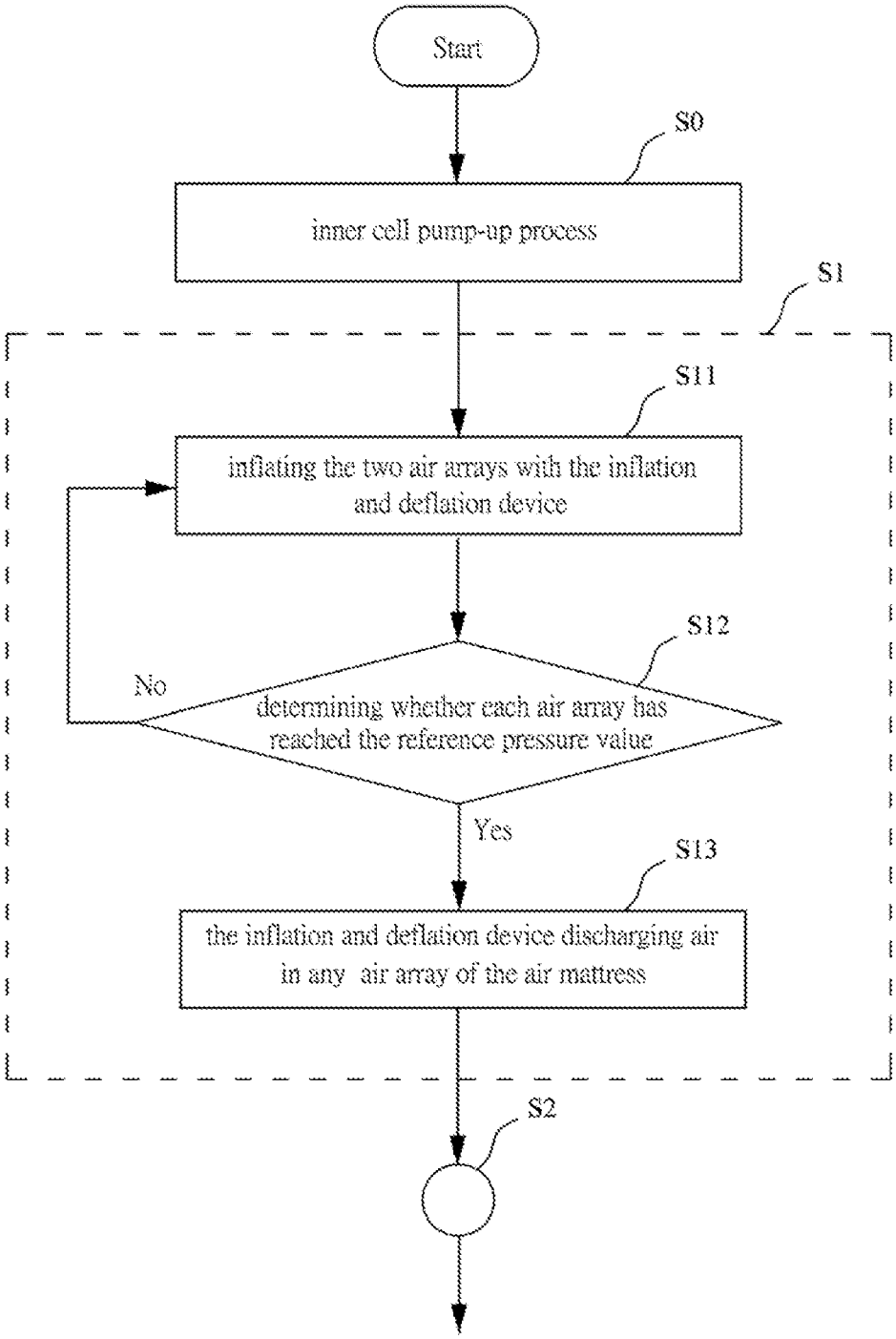
FIG. 6 illustrates a partial flowchart of the second embodiment of the inflation and deflation pressure regulation method.

FIG. 6 illustrates a partial flowchart of the second embodiment of the inflation and deflation pressure regulation method applicable to the above-recited air mattress system 1. As illustrated in FIG. 5 and FIG. 6, this embodiment is different from the process exemplified in FIG. 2 in that the method shown in FIG. 6 contains an inner cell pump-up process in Step S0 before the automated detection for inflation and deflation process of Step S1. In this embodiment, the first air array A and the second air array B of the air mattress 14 contain respective independent inner cells and outer cells. Therefore, during the inflation operation, the first inner cell A1 and the second inner cell B1 located at the bottom have to be fully inflated to serve as a supporting base of the air mattress 14. After that, with the operation similar to that described in Step S1, the control unit 13 may enable the inflation and deflation device 11 to inflate the first air array A and the second air array B, until the pressure in both the first air array A and the second air array B has reached the reference pressure value. Finally, the air discharge operation recited in Step S13 is performed for the first outer cell A2 on the first inner cell A1 or for the second outer cell B2 on the second inner cell B1, so as to proceed with the same inflation and deflation pressure regulation of the air mattress 14 using the method with only one single air array inflated.

The inner cell pump-up process comprises a first inner cell pump-up process and a second inner cell pump-up process. Before inflating the first air array A and the second air array B to the reference pressure value, the inflation and deflation device 11 may inflate the first outer cell A2 and the second inner cell B1. The first check valve C1 may prevent leakage of air filled into the second inner cell B1, such that after the second inner cell B1 and the first outer cell A2 have been inflated to an inflation pressure value, the second inner cell B1 may be maintained at the inflation pressure value;

afterwards, the first outer cell A2 is then deflated to complete the second inner cell pump-up process.

Similarly, the inflation and deflation device 11 may also inflate the second outer cell B2 and the first inner cell A1. The second check valve C2 may prevent leakage of air filled into the first inner cell A1, such that after the first inner cell A1 and the second outer cell B2 have been inflated to the inflation pressure value, the first inner cell A1 may be maintained at the inflation pressure value; afterwards, the second outer cell B2 is then deflated to complete the first inner cell pump-up process. The inflation pressure value may be preset and stored for the control unit 13, and in this embodiment, the inflation pressure value may be greater than the reference pressure value but not limited thereto.

Accordingly, the present invention allows inflation and deflation pressure regulation of an air mattress when the outer cell volume of each air array is fixed, so as to ensure accuracy and efficiency of air mattress inflation and deflation pressure regulation.

The above detailed description is merely illustrative in nature and is not intended to limit the embodiments of the subject matter or the application and uses of such embodiments. Moreover, while at least one exemplary embodiment has been presented in the foregoing detailed description, it should be appreciated that a vast number of variations exist. It should also be appreciated that the exemplary one or more embodiments described herein are not intended to limit the scope, applicability, or configuration of the claimed subject matter in any way. Rather, the foregoing detailed description will provide those skilled in the art with a convenient guide for implementing the described one or more embodiments. Also, various changes can be made in the function and arrangement of elements without departing from the scope defined by the claims, which include known equivalents and foreseeable equivalents at the time of filing this patent application.

What is claimed is:

1. An inflation and deflation pressure regulation system applicable to an air mattress with at least two air arrays, the inflation and deflation pressure regulation system comprising:

an inflation and deflation device for inflating or deflating the air mattress;

a pressure detection unit for continuously detecting an instantaneous pressure value of the air mattress; and a control unit for automatically enabling the air mattress inflation or deflation, wherein the control unit determines a target pressure value according to a time-based table and controls the inflation and deflation device to inflate or deflate the air mattress when the instantaneous pressure value reaches a preset pressure value before a preset time, wherein the control unit determines the target pressure value according to a pressure-based table and controls the inflation and deflation device to inflate or deflate the air mattress when the instantaneous pressure value fails to reach the preset pressure value before the preset time, wherein the pressure-based table is a separate table from the time-based table, and the time-based table and the pressure-based table are individually independent, and wherein the air mattress is in a weight-bearing state.

2. The inflation and deflation pressure regulation system of claim 1, wherein, before the determination by the control unit, the inflation and deflation device is configured to inflate each air array to a reference pressure value and then discharges air in any one of the air arrays of the air mattress.

3. The inflation and deflation pressure regulation system of claim 1, wherein the air mattress is configured to be inflated or deflated according to the difference between the instantaneous pressure value and the target pressure value corresponding to one of a plurality of different time intervals related to the time required to reach the preset pressure.

4. The inflation and deflation pressure regulation system of claim 2, wherein the air mattress is configured to be inflated or deflated according to the difference between the instantaneous pressure value and the target pressure value corresponding to one of a plurality of different time intervals related to the time required to reach the preset pressure.

5. The inflation and deflation pressure regulation system of claim 2, wherein the air mattress is configured to be inflated or deflated according to the difference between the instantaneous pressure value and the target pressure value corresponding to one of a plurality of different compared pressure differences related to a pressure difference between the reference pressure value and the instantaneous pressure value obtained when the preset time has elapsed.

6. The inflation and deflation pressure regulation system of claim 1, wherein the inflation and deflation device further comprises a deflation unit switched on during the operation of the inflation and deflation device to provide heat dissipation.

7. The inflation and deflation pressure regulation system of claim 2, wherein the control unit comprises a processor and an analog-to-digital converter, the processor determining whether the instantaneous pressure value has reached the preset pressure value before the preset time has elapsed, the analog-to-digital converter being electrically connected with the processor and the pressure detection unit, the analog-to-digital converter processing the instantaneous pressure value obtained from the pressure detection unit and transmitting the processed instantaneous pressure value to the processor.

8. The inflation and deflation pressure regulation system of claim 7, wherein the control unit further comprises a memory electrically connected with the processor to save the reference pressure value, the instantaneous pressure value, the preset pressure value and the preset time.

9. The inflation and deflation pressure regulation system of claim 1, wherein the preset time is selected from any time point within a time range.

10. An inflation and deflation pressure regulation method applicable to an air mattress with at least two air arrays, performed by the inflation and deflation pressure regulation system as recited in claim 1, the method comprising the following steps:

performing an automated detection for inflation and deflation process, during which a control unit continuously obtains an instantaneous pressure value of the air mattress detected by a pressure detection unit and enables an inflation and deflation device to discharge air in any one of the air arrays of the air mattress; and using the control unit to determine whether the instantaneous pressure value of the air mattress in a weight-bearing state has reached a preset pressure value before a preset time has elapsed.

11. The inflation and deflation pressure regulation method of claim 10, wherein the inflation and deflation device is enabled to discharge air in any one of the air arrays of the air mattress by the following steps:

inflating the two air arrays with the inflation and deflation device;

determining whether each air array has reached a reference pressure value; and if so, the inflation and deflation device discharging air in any one of the air arrays of the air mattress.

12. The inflation and deflation pressure regulation method of claim 11, further comprising the following step prior to inflating the two air arrays with the inflation and deflation device:

the inflation and deflation device performing an inner cell pump-up process on the two air arrays.

13. The inflation and deflation pressure regulation method of claim 10, wherein when the first inflation and deflation strategy is used, the air mattress is inflated or deflated according to the difference between the instantaneous pressure value and a target pressure value corresponding to one of a plurality of different time intervals related to the time required to reach the preset pressure.

14. The inflation and deflation pressure regulation method of claim 11, wherein when the first inflation and deflation strategy is used, the air mattress is inflated or deflated according to the difference between the instantaneous pressure value and a target pressure value corresponding to one of a plurality of different time intervals related to the time required to reach the preset pressure.

15. The inflation and deflation pressure regulation method of claim 12, wherein when the first inflation and deflation strategy is used, the air mattress is inflated or deflated according to the difference between the instantaneous pressure value and a target pressure value corresponding to one of a plurality of different time intervals related to the time required to reach the preset pressure.

16. The inflation and deflation pressure regulation method of claim 11, wherein when the second inflation and deflation strategy is used, the air mattress is inflated or deflated according to the difference between the instantaneous pressure value and a target pressure value corresponding to one of a plurality of different compared pressure differences related to the difference between the reference pressure value and the instantaneous pressure value obtained when the preset time has elapsed.

17. The inflation and deflation pressure regulation method of claim 12, wherein when the second inflation and deflation strategy is used, the air mattress is inflated or deflated according to the difference between the instantaneous pressure value and a target pressure value corresponding to one of a plurality of different compared pressure differences related to the difference between the reference pressure value and the instantaneous pressure value obtained when the preset time has elapsed.

18. An air mattress system, comprising:

an air mattress comprising a first air array and a second air array, the first air array comprising a first inner cell and a first outer cell, the second air array comprising a second inner cell and a second outer cell, the first outer cell being communicated with the second inner cell via a first check valve, the second outer cell being communicated with the first inner cell via a second check valve; and the inflation and deflation pressure regulation system of claim 1 in air communication with the air mattress, wherein the inflation and deflation pressure regulation system inflates each of the first air array and the second air array to a reference pressure value.

19. The air mattress system of claim 18, wherein prior to the inflation and deflation pressure regulation system inflating each of the first air array and the second air array to the reference pressure value, the inflation and deflation pressure regulation system inflates the first outer cell and the second inner cell to an inflation pressure value and then deflates the first outer cell so as to complete a second inner cell pump-up process, and then the inflation and deflation pressure regulation system inflates the second outer cell and the first inner cell to the inflation pressure value and then deflates the second outer cell so as to complete a first inner cell pump-up process.

* * * * *